United States Patent [19]

Sommer

[11] 4,450,959

[45] May 29, 1984

[54] PACKAGING FOR ELECTRICAL COMPONENTS

[75] Inventor: Alfons Sommer, Munich, Fed. Rep. of Germany

[73] Assignee: Siemens Aktiengesellschaft, Berlin and Munich, Fed. Rep. of Germany

[21] Appl. No.: 312,363

[22] Filed: Oct. 16, 1981

[30] Foreign Application Priority Data

Oct. 30, 1980 [DE] Fed. Rep. of Germany ..... 3040959

[51] Int. Cl.[3] ..... B65D 73/02; B65D 85/42

[52] U.S. Cl. ..... 206/332; 206/334; 206/461; 206/538

[58] Field of Search ..... 206/329, 332, 331, 587, 206/538, 461, 334

[56] References Cited

U.S. PATENT DOCUMENTS

| | | | |
|---|---|---|---|
| 739,487 | 9/1903 | Gair | 206/587 |
| 2,863,595 | 11/1958 | Emery | 206/587 |
| 3,195,770 | 7/1965 | Robertson | 206/538 |
| 3,608,711 | 9/1971 | Wiesler | 206/329 |
| 3,926,308 | 12/1975 | Sullivan | 206/332 |
| 4,193,287 | 3/1980 | Pfeiffer | 206/329 |
| 4,298,120 | 11/1981 | Kaneko et al. | 206/332 |

*Primary Examiner*—Joseph Man-fu Moy

*Attorney, Agent, or Firm*—Herbert L. Lerner; Laurence A. Greenberg

[57] ABSTRACT

Packaging for single electrical components, including a preformed, one-piece plastic foil having receptacles for individual components formed therein, and a one-piece adhesive foil closing the receptacles with the components disposed therein.

7 Claims, 2 Drawing Figures

PACKAGING FOR ELECTRICAL COMPONENTS

Figure 1:
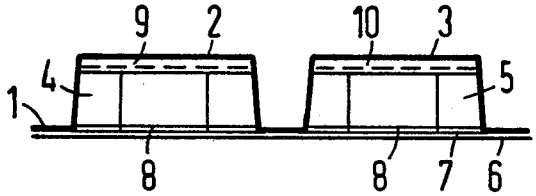

The invention relates to the packaging of single electrical components.

When dealing with components of this type, especially as far as sensitive, ceramic components are concerned, such as ferritepot cores, the present practice is to manually place these items into styropor pallets, singly or in pairs or sets. These pallets are stacked to form packaging units, covered with corrugated cardboard endplates and connected by adhesive tape with each other.

During this packaging method, a series of difficulties are encountered. Besides the low packaging density, because of which a great deal of storage space is used up by the empty and filled packages, the high insurance costs for the storage space due to the danger of fire caused by the styropor, must also be mentioned. Furthermore, it must also be mentioned that in packaging of this type, a division of the packaging for small amounts (single parts, sets or pairs) is only achieved along with high re-packaging costs, and with reduced packaging quality.

A mechanized and automated positioning and insertion of the parts onto the styropor pallets is connected with such high costs that it is impractical.

It is accordingly an object of the invention to provide a packaging for electrical components, which overcomes the hereinafore-mentioned disadvantages of the heretofore-known devices of this general type. It is especially on objective to provide a packaging whereby the electrical components can be packaged fully automatically, and without any auxiliary manual operations.

With the foregoing and other objects in view there is provided, in accordance with the invention, a packaging for single electrical components, comprising a preformed, one-piece plastic foil having receptacles for individual components formed therein, and a one-piece adhesive foil closing the receptacle with the components disposed therein.

In accordance with another feature of the invention, there is provided a masking foil in the vicinity of the receptacles covering the adhesive layer of the adhesive foil.

In accordance with a further feature of the invention, there are provided damping ribs at the bottom of the receptacles.

In accordance with an added feature of the invention, there are provided gripping lugs for tearing being integral with the plastic foil.

In accordance with an additional feature of the inention, the plastic foil is formed of PVC.

In accordance with again another feature of the invention, the adhesive foil is in the form of a laminated paper foil having an adhesive layer disposed thereon.

In accordance with a concomitant feature of the invention, the receptacles are conically shaped or tapered.

Other features which are considered as characteristic for the invention are set forth in the appended claims.

Although the invention is illustrated and described herein as embodied in a packaging for electrical components, it is nevertheless not intended to be limited to the details shown, since various modifications and structural changes may be made therein without departing from the spirit of the invention and within the scope and range of equivalents of the claims.

Figure 2:
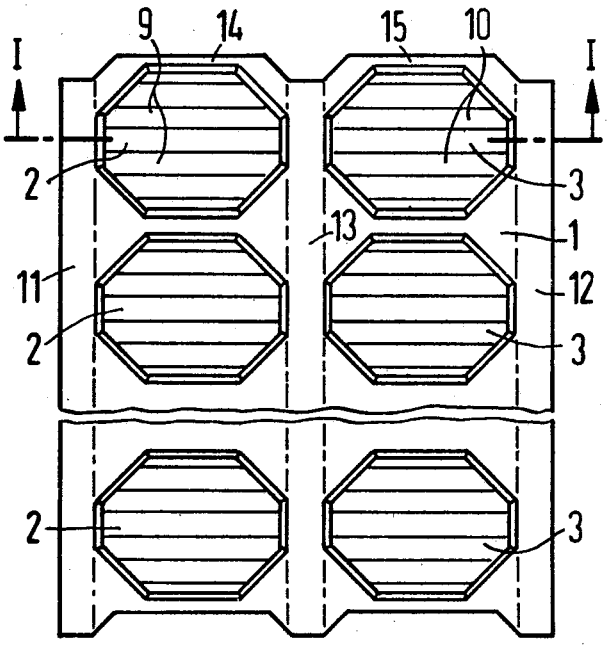

The construction and method of operation of the invention, however, together with additional objects and advantages thereof will be best understood from the following description of specific embodiments when read in connection with the accompanying drawings, in which:

FIG. 1 is a diagrammatic cross-sectional view taken along the line I-I in FIG. 2 in the direction of the arrows; and FIG. 2 is a fragmentary top-plan view onto the packaging according to the invention.

Referring now to the figures of the drawing and first particularly to FIG. 1 thereof, there is seen a section through the packaging according to the invention, in which, as described in the hereinafore-mentioned embodiments, two rows of electrical components, such as paired ferrite-pot cores, are packaged. The packaging includes a pre-formed, one-piece plastic foil 1 in which receptacle-cups 2, 3 are disposed. In the receptacles 2, 3 are the electrical components 4, 5 (in the embodiment according to FIG. 1 these are ferrite-pot cores). The receptacles 2, 3 are closed with a one-piece adhesive foil. The adhesive foil is formed of a paper band 6 on which an adhesive layer 7 is disposed. The adhesive layer 7 bonds the paper band 6 with the plastic foil 1. In the vicinity of the receptacles 2,3, the adhesive layer 7 is provided with a masking foil 8, which can be made of silicon paper, for example. Damping ribs 9, 10 are disposed at the receptacles 2, 3 by way of which shock and pressure loads are kept away from the electrical components 4, 5.

It can be seen in FIG. 2 that the receptacles 2, 3 in which the electrical components are disposed, are in turn disposed in the plastic foil 1. The damping ribs 9, 10 are located at the receptacles 2, 3.

Within both dashed edge strips 11, 12 and at a middle-stripe 13, the masking foil is removed from the adhesive foil, which is not visible in the figure, so that at these stripes the bonding of the paper foil with the plastic foil 1 is effected.

Gripping lugs 14, 15 which are disposed at the packaging, facilitate the opening of the package.

The automatic packaging operation is, for example, performed in such a manner that the receptacles 2, 3 including the damping ribs 9, 10 are drawn or formed by pressurized air in the heated band-shaped plastic foil 1, which may be PVC(polyvinylchloride) or polystyrol, for example. After inserting the electrical components 4, 5, the receptacles 2, 3 are closed by rolling under pressure with the paper closure-foil 6 which is coated with the adhesive 7. For this purpose it is possible, for example, to select a one-piece paper closure-foil 6 having its adhesive layer 7 masked by a masking foil (for example made of silicon paper). The edge stripes 11, 12 and the middle stripe 13 are provided in the masking foil in the regions of the areas which are to be bonded, and the masking foil is stripped from these places before closing the receptacles 2, 3.

In order to open the package, the paper-closure foil is picked up at the tear-gripping lugs 14, 15 and separated from the plastic foil. Because of the provision that the adhesive layer is only located in the region of the edge stripes 11, 12 and the middle stripe 13, the package can be cleanly and rapidly opened without interfering pieces remaining. The masking foil 8 therefore serves as tearing means during this operation.

Because of the forming of conically-shaped receptacles 2, 3, it is possible to obtain an advantage which is that the electrical components 4, 5 can be easily removed from the receptacles 2, 3 after opening.

The individual sections can be separated in suitable amounts as in the embodiment shown in FIG. 2, for example, whereby it is practical to generate the gripping lugs 14, 15 during the cut-off operation, and the cut off sections are then further packaged, for example, in a carton. However, there is also the possibility of rolling the packages in an endless spool, and storing them in this form.

During both packaging modes, and advantage results which is that shock and pressure loads are absorbed in the horizontal as well as the vertical direction, so that a high packaging quality is assured. This is due to the fact that the contours of the receptacles are separated from each other, and that damping ribs are provided at the bottom of the receptacles.

Furthermore, by the use of only thin-walled foil as the packaging material, high packaging density is assured. Thus, only a small storage space is required for the finished packages.

Furthermore, the insurance costs for the storage of plastic foil are lower than for styropor packaging.

A further advantage of the packaging according to the invention is that the packaging can be divided into minimum amounts without thereby reducing the packaging quality.

Obviously, the invention is not limited to the typical example shown in the figures. The electrical component can also be packaged in a single row, whereby in the masking foil only, two depressed scores are then provided, and thus only two stripes can be pulled off at the edge of the masking foil. The closure foil is then bonded to the plastic foil by the two exposed adhesive stripes.

On the other hand, three, four or more rows of components can obviously also be adjacently packaged, in which case corresponding scores or notches must then be formed in the masking foil.

Furthermore, because the starting materials are also provided in the form of thin rolled-up foils, only a specially small space is required for the storage of these materials before their use.

By virtue of the packaging of the electrical components in a single, double or multiple rows, and the smooth surface structure of the foil, the electrical components can be fully automatically positioned and inserted into the receptacles. The receptacles are formed or drawn in the plastic foil corresponding to the size of the electrical components which are to be packaged.

There are claimed:

1. Packaging for single electrical components, comprising a pre-formed, one piece plastic foil having receptacles for individual components formed therein, in a single row and having edge strips beyond said receptacles a one-piece adhesive foil closing said receptacles with the components disposed therein, said adhesive foil having areas opposite said edge strips of said plastic foil, and a masking foil disposed in the vicinity of said receptacles covering the adhesive of said adhesive foil except in said areas opposite said edge strips, and said masking foil-free areas of said adhesive foil being bonded to said edge strips of said plastic foil.

2. Packaging according to claim 1, wherein damping ribs are provided at the bottom of said receptacles.

3. Packaging according to claim 1, including gripping lugs for tearing being integral with said plastic foil.

4. Packaging according to claim 1, wherein said plastic foil is formed of PVC.

5. Packaging according to claim 1, wherein said adhesive foil is in the form of a laminated paper foil having an adhesive layer disposed thereon.

6. Packaging according to claim 1, wherein said receptacles are conically shaped.

7. Packaging for single electrical components, comprising a pre-formed, one-piece plastic foil having receptacles for individual components formed therein, in a plurality of rows and having edge strips beyond said receptacles and middle strips between said receptacles, a one-piece adhesive foil closing said receptacles with the components disposed therein, said adhesive foil having areas opposite said edge strips and middle strips of said plastic foil, and a masking foil disposed in the vicinity of said receptacles covering the adhesive of said adhesive foil except in said areas opposite said edge strips and middle strips, and said masking foil-free areas of said adhesive foil being bonded to said edge strips and middle strips of said plastic foil.

* * * * *